US005284451A

United States Patent [19]

Chiu

[11] Patent Number: 5,284,451

[45] Date of Patent: Feb. 8, 1994

[54] DISCHARGE DEVICE FOR A WATER-COOLED ENGINE

[76] Inventor: Yu-Mei Chiu, 1F, No. 312, Derhsing East Rd., Taipei, Taiwan

[21] Appl. No.: 942,848

[22] Filed: Sep. 10, 1992

[51] Int. Cl.[5] ..... B63H 21/38

[52] U.S. Cl. ..... 440/89

[58] Field of Search ..... 440/53, 88, 89; 60/310, 60/313; 181/204, 220, 221, 235, 238, 264, 269

[56] References Cited

U.S. PATENT DOCUMENTS 3,921,398 11/1975 Kashmerick ..... 440/89
4,019,456 4/1977 Harbert ..... 440/89
4,989,409 2/1991 Nakase et al. ..... 440/89
5,078,631 1/1992 Harbert ..... 440/89
5,096,446 3/1992 Tazaki et al. ..... 440/89

*Primary Examiner*—David M. Mitchell
*Assistant Examiner*—Stephen P. Avila
*Attorney, Agent, or Firm*—Bacon & Thomas

[57] ABSTRACT

Exhaust gas and spent cooling water from a water-cooled engine is discharged through a compartment having separate upper and lower pipes for discharging, respectively, the exhaust gas and spent cooling water, thereby avoiding undesirable mixing of the gas and water and enhancing engine performance.

2 Claims, 3 Drawing Sheets

DISCHARGE DEVICE FOR A WATER-COOLED ENGINE

BACKGROUND OF THE INVENTION

A conventional water-cooled engine, such as used in a remote controlled boat and shown in FIG. 1, includes a water pumping mechanism 1 attached to the engine to take in water from the rear of the boat and pump same into the interior of the engine to cool same. The spent cooling water is then pumped out of the engine and drained from the boat together with the engine exhaust gas through a discharge mechanism 2. However, discharge mechanism 2 is of a single pipe design and must simultaneously discharge both the exhaust gas and spent cooling water through the single pipe during use. The single pipe configuration causes the exhaust gas and spent cooling water to constantly impact upon each other, undergo undesirable mixing within mechanism 2, require an increase in energy consumption and result in reduction in engine performance.

SUMMARY OF THE INVENTION

The present invention overcomes the disadvantages of a conventional single pipe discharge mechanism by providing an improved discharge device for a water-cooled engine wherein there is no undesirable mixing of the exhaust gas with the spent cooling water, a reduction in noise and energy consumption during operation of the engine, and enhanced engine performance. This is realized by providing a device having a compartment into which the engine exhaust gas and spent cooling water are separately directed. The compartment includes an outlet end having two independent discharge pipes, with one pipe disposed at an upper level and the other pipe disposed at a lower level. Since the exhaust gas is lighter than the spent cooling water, the former will automatically separate from the cooling water and be independently discharged through the upper pipe while the latter is automatically discharged through the lower pipe. In this way, the exhaust gas and spent cooling water do not undergo undesirable mixing within the compartment and may easily and independently be discharged through the separate pipes of the device.

DETAILED DESCRIPTION OF THE PREFERRED EMBODIMENT

Figure 1:
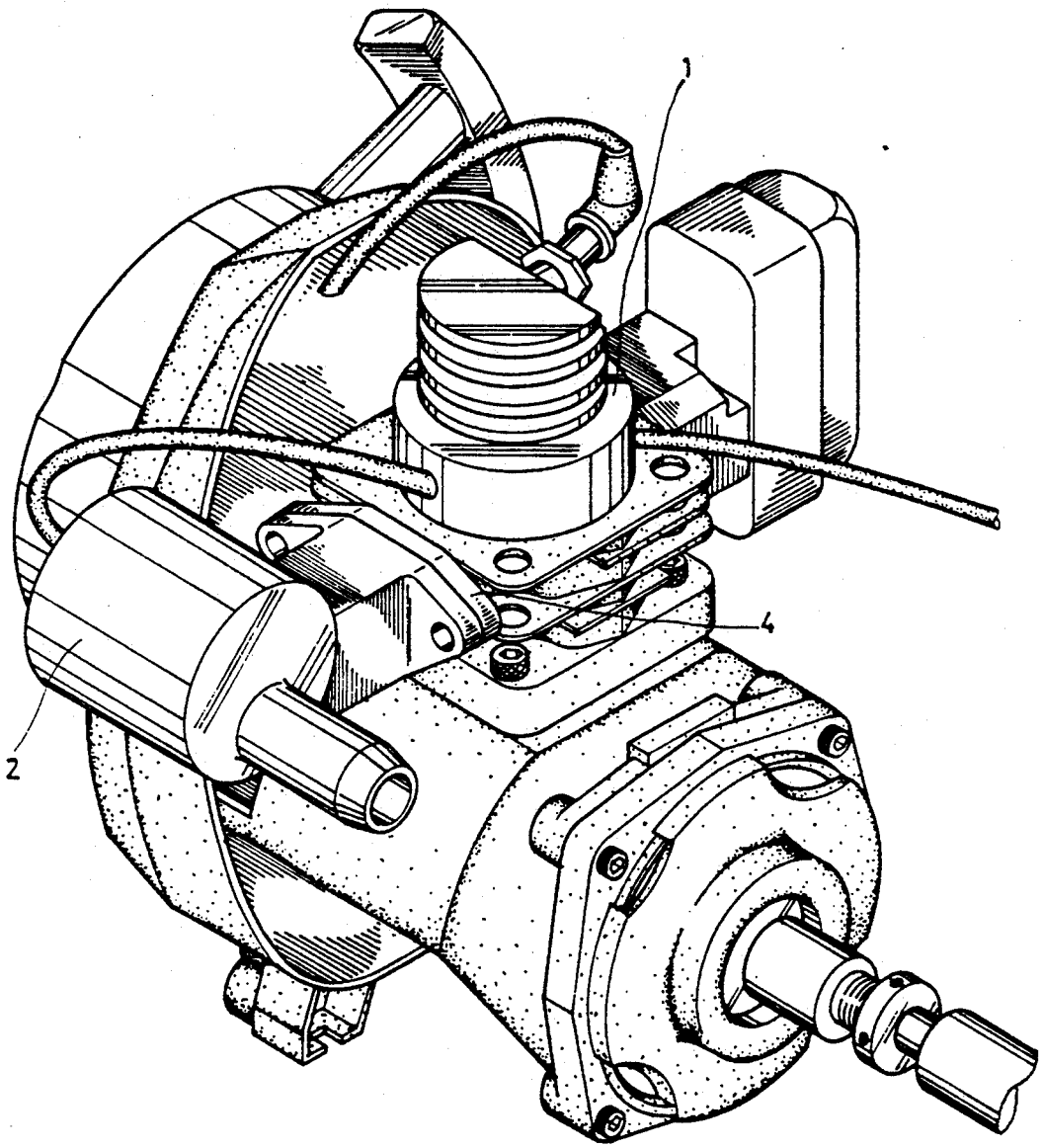
FIG 1 (PRIOR ART)
FIG. 1 is a perspective view of a prior art water-cooled engine equipped with a discharge mechanism having a single pipe for discharging both engine exhaust gas and spent cooling water.
Figure 2:
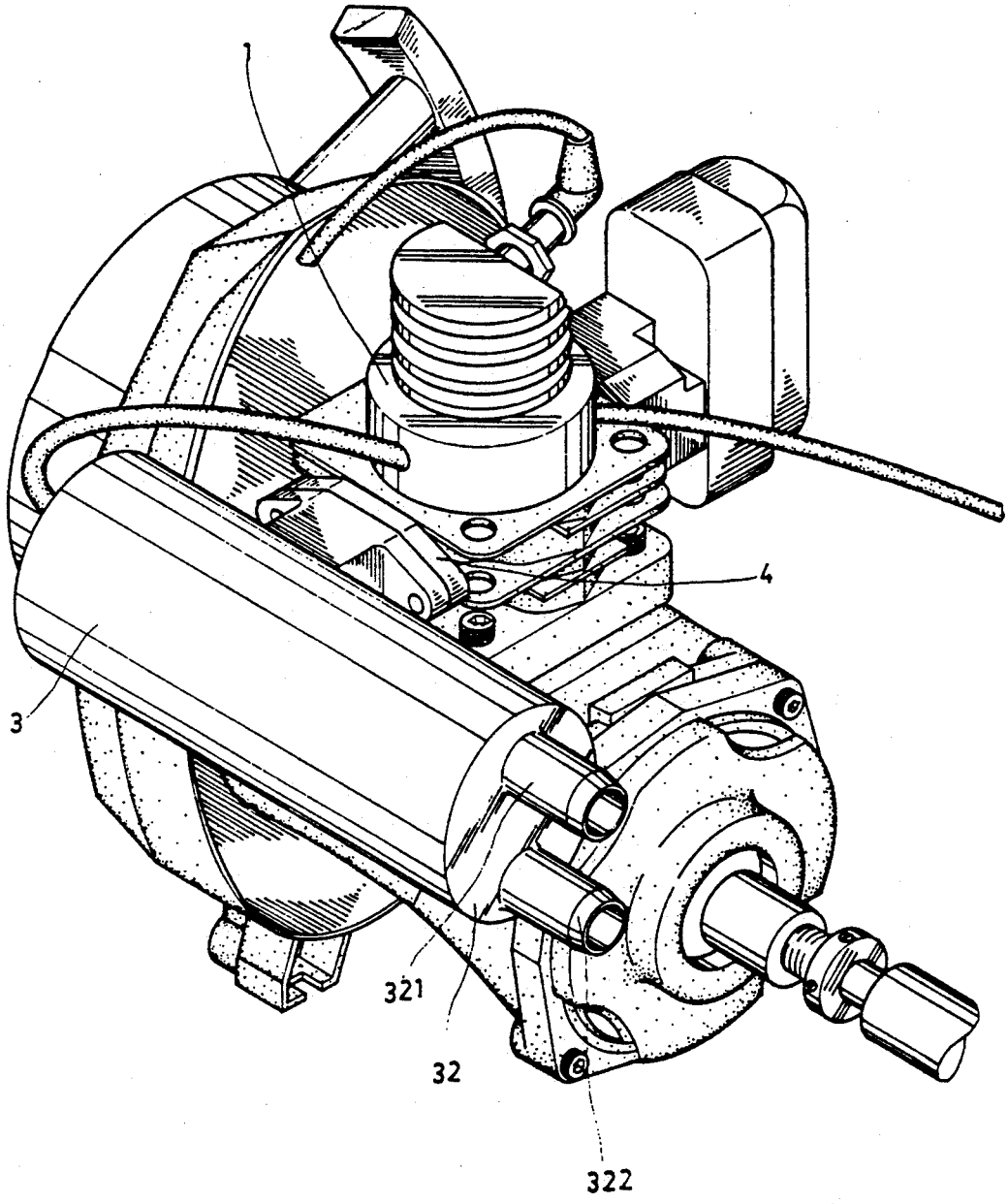
FIG. 2 is a perspective view of a water-cooled engine provided with the discharge device of the present invention.

A discharge device of the present invention for use with a water-cooled engine, such as of the type used in a remote control boat, shall now be described with reference to FIGS. 2 and 3. As shown therein, the discharge device is attached to the engine for receiving and discharging both the engine exhaust gas and the spent cooling water therefrom. The spent cooling water is pumped into the discharge device by a water-pumping mechanism 1 and the exhaust gas from the engine is directed to the device through an exhaust manifold 4 of the engine, as particularly shown in FIG. 2.

Figure 3:
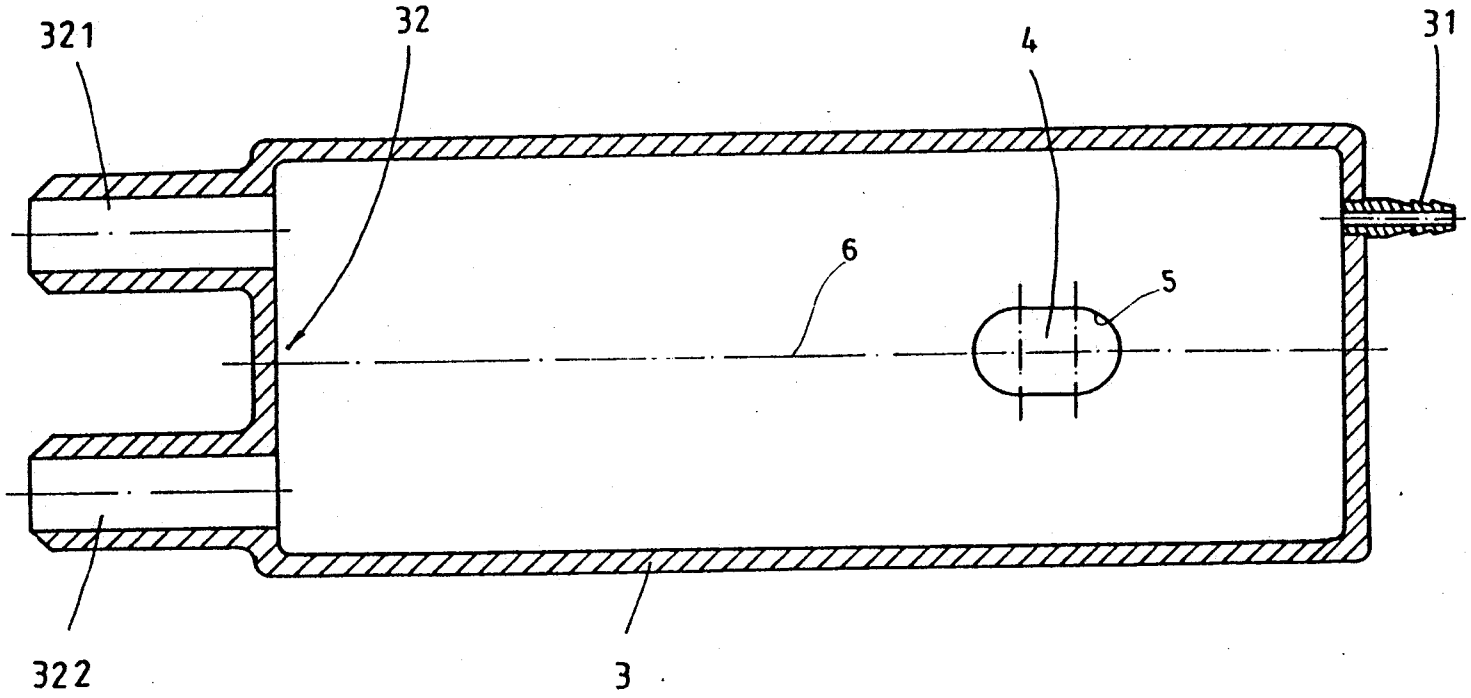
FIG. 3 is a longitudinal cross-sectional view of the discharge device of the invention.

The discharge device, as detailed in FIG. 3, includes a compartment 3 having a longitudinal axis 6. A spent cooling water inlet 31, defining an inlet path parallel to axis 6 is provided at one end of compartment 3 for connection to the water-pumping mechanism 1 of the engine. An aperture 5, defining an inlet path perpendicular to axis 6, is provided in the side of compartment 3 for receiving engine exhaust gas from exhaust manifold 4. The other end of compartment 3 forms a discharge outlet 32 that includes an upper pipe 321 for discharging exhaust gas and a lower pipe 322 for discharging spent cooling water, with pipes 321 and 322 defining discharge paths parallel to axis 6. It shall be appreciated that compartment 3 is of a large size to facilitate receiving the exhaust gas and spent cooling water from the engine, and both separately and simultaneously discharging same through independent pipes 321 and 322.

Since the specific gravity of the spent cooling water is greater than that of the engine exhaust gas, the cooling water will remain at the lower portion of compartment 3 and automatically discharges therefrom through lower pipe 322. The exhaust gas, being much lighter than the cooling water, easily rises to the upper portion of compartment 3 and automatically discharges therefrom through upper pipe 321. Thus, outlet end 32 of compartment 3 provides two independent discharge pipes 321 and 322 for separately discharging exhaust gas and cooling water, respectively.

It is also apparent that the discharge device of the invention permits the exhaust gas and spent cooling water to be easily received within compartment 3 and discharged from pipes 321 and 322 without undesirable mixing thereof which would otherwise generate noise. Moreover, the construction of the device facilitates the separate discharge of the exhaust gas and cooling water, thereby reducing discharge resistance and enhancing engine performance.

The primary purpose of the invention is to provide an improved exhaust gas and spent cooling water discharge device for a water-cooled engine, particularly of the type utilized with a remote controlled boat. The device eliminates the undesirable noise realized with known devices of this type and results in optimum engine performance. It also meets the requirements of consumers. A secondary purpose of the invention is to provide a discharge device having a dual pipe discharge end for separately discharging waste gas and cooling water without mixing or congesting the gas and water.

I claim:

1. A discharge device for a water-cooled engine for receiving and discharging spent cooling water from a water pumping mechanism and exhaust gas from an exhaust manifold, the improvement comprising: a compartment including a longitudinal axis and provided with a first inlet for receiving spent cooling water from a water pumping mechanism, a second inlet for receiving exhaust gas from an exhaust manifold, an outlet defined by an upper pipe for discharging exhaust gas and a lower pipe for discharging spent cooling water from the compartment, and the upper and lower pipes defining discharge paths parallel to the longitudinal axis of the compartment.

2. The discharge device of claim 1 wherein the first inlet defines an inlet path parallel to the longitudinal axis, and the second inlet defines an inlet path perpendicular to the longitudinal axis.

* * * * *